US005551753A

United States Patent [19]

Glöckl

[11] Patent Number: 5,551,753

[45] Date of Patent: Sep. 3, 1996

[54] ACTIVE DYNAMIC SEAT

[76] Inventor: Josef Glöckl, Ammerseestrasse 6, D-8011 Kirchheim, Germany

[21] Appl. No.: 150,107

[22] PCT Filed: Mar. 29, 1993

[86] PCT No.: PCT/EP93/00758

§ 371 Date: Feb. 24, 1994

§ 102(e) Date: Feb. 24, 1994

[87] PCT Pub. No.: WO93/19650

PCT Pub. Date: Oct. 14, 1993

[30] Foreign Application Priority Data

Mar. 27, 1992 [DE] Germany ..... 42 10 099.2

[51] Int. Cl.[6] ..... A47C 1/023

[52] U.S. Cl. ..... 297/314; 297/198; 297/209; 297/452.49; 248/600; 248/604

[58] Field of Search ..... 297/313, 314, 297/302, 304, 198, 209, 452.5, 452.49, 302.4, 303.4; 248/604, 600, 623, 626

[56] References Cited

U.S. PATENT DOCUMENTS

| | | | |
|---|---|---|---|
| 621,139 | 3/1899 | Reuter | 297/314 |
| 1,398,935 | 11/1921 | Miller | 297/314 |
| 2,048,148 | 7/1936 | Stoll . | |
| 2,273,186 | 2/1942 | Roberti . | |
| 2,719,571 | 10/1955 | Taylor . | |
| 3,572,621 | 3/1971 | Whitten | 248/600 |
| 4,765,617 | 8/1988 | Groves | 297/209 |

FOREIGN PATENT DOCUMENTS

| | | | |
|---|---|---|---|
| 0040649 | 7/1932 | France | 248/600 |
| 2460649 | 3/1981 | France | 248/623 |
| 0900867 | 7/1949 | Germany . | |
| 2087225 | 5/1982 | United Kingdom . | |

*Primary Examiner*—Peter M. Cuomo
*Assistant Examiner*—Anthony D. Barfield
*Attorney, Agent, or Firm*—Birch, Stewart, Kolasch & Birch, LLP.

[57] ABSTRACT

An active dynamic seat has a base, an intermediate piece linked to the base and a seat part linked to the intermediate piece. The seat part can tilt in all lateral directions and is linked in an essentially fixed manner in the vertical direction to the intermediate piece. One or more restoring devices act on the seat part. The intermediate piece is fixed at its lower end to the base and is resilient in the vertical direction. In another embodiment of the invention, the seat part is linked to the intermediate piece by several spring strips distributed around the periphery of the seat part and of the intermediate piece.

9 Claims, 3 Drawing Sheets

ACTIVE DYNAMIC SEAT

The invention relates to an active dynamic seat.

BACKGROUND OF INVENTION

Conventional seating furniture is designed in most cases so that the body, especially the back, is supported by correspondingly fashioned seating surfaces and backs in an anatomically maximally favorable position. Although such seating furniture is frequently felt to be comfortable, there is the decisive drawback that the body sits merely passively on such seats, i.e. the back muscles are hardly stressed, and the intervertebral disks are stressed merely statically in the "pressure mode". As a result, a long-term usage of such seat furnishings leads to degeneration of the back muscles and wasting of the intervertebral disks. Impairment of health and pains in the back and hip regions (e.g. sciatica) are the frequent consequence of such static and passive sitting.

For this reason, seating furnishings have been developed permitting a so-called active dynamic sitting wherein the back musculature and the intervertebral disks are constantly slightly active. This active dynamic sitting attitude is attained in practically all cases by maintaining the actual seat of the seating furniture in a labile position and making it optionally additionally resilient in the vertical direction.

Such an active dynamic seating device has been described, for example, in DE 73 11 140. This seat consists essentially of a seat part connected via a first tilting joint with a supporting shank, the latter, in turn, being articulated by means of a second tilting joint to the base of the seating device. In this arrangement, each tilting joint consists preferably of a cap formed respectively at the end of the supporting shank, this cap being guided in a hollow cylinder and stressed by a coil spring arranged in the hollow cylinder.

On account of the planar structure of the underside of the cap, the latter is in contact, in the non-stressed condition, with the bottom or, respectively, top of the hollow cylinder so that, without stress, a perfect alignment is achieved of base, supporting shank, and seat. When stress is exerted on this seating device, the two coil springs of the tilting joints are compressed, the two caps being urged into the two hollow cylinders. The tilting movement of these two joints is attained by the feature that the bore in the top of the lower cylinder or, respectively, in the bottom of the upper hollow cylinder is slightly larger than the outer diameter of the supporting shank.

However, the disadvantage arises herein that the maximally possible tilting angle of each tilting joint in the stressed condition is dependent on the distance of the planar side of the cap from the bottom or top of the hollow cylinder and thus on the weight of the person presently using this seating device. Moreover, it is extremely difficult to maintain one's balance on this seating device so that, at least for inexperienced users, there must be the possibility that at least one of the tilting joints is blocked. This results from the fact that, upon deflection of the tilting joint at the base of the seating device into a specific direction, a deflection of the upper tilting joint in the same direction takes place in a preferred manner.

SUMMARY OF THE INVENTION

The invention is based, therefore, on the object of providing an active dynamic seat ensuring, on the one hand, a seating position active to an adequate extent and, on the other hand, permitting a harmless use of the seating device even without a prolonged training phase and/or familiarization phase.

Moreover, the invention is based on the task of creating an active dynamic seat that can be produced in a simple and economical way.

On account of the self-restoring mounting of the seat part, tiltable in any lateral direction, in the upper end of the intermediate piece with a simultaneous rigid connection of the foot of the intermediate piece with the base of the seating device, a labile equilibrium and thus active sitting without any appreciable transverse movements of the seat part are made possible. Thus, any danger to inexperienced users is avoided.

By the special construction of the intermediate piece as an arcuate component resilient in the vertical direction, the active sitting position is also still further improved in addition to enhancement of sitting comfort.

In a preferred embodiment of the invention, the arcuate intermediate piece exhibits a second arcuate part arranged within the first arcuate part, the lower arm of this second arcuate part being connected with the lower arm of the first arcuate part. This second arcuate part is of such a structure in this arrangement that a gap is formed, at least within a certain zone between the first and second arcuate parts, this gap increasing with increasing distance from the connecting point of the parts, and that a substantially wedge-shaped part is displaceably arranged in this gap for setting a desired spring hardness.

In a further embodiment of the invention, the seat part is connected to the intermediate piece by means of several spring strips distributed over the periphery of the seat part and of the intermediate piece. This makes it possible to execute, in addition to a pure tilting movement about a fixed point, also small purely transversal movements, or combinations of tilting and transverse movements.

Additional embodiments of the invention can be seen from the dependent claims.

BRIEF DESCRIPTION OF THE DRAWINGS

The invention will be described in greater detail below with reference to embodiments illustrated in the drawings wherein.

DETAILED DESCRIPTION OF THE EMBODIMENTS

Figure 1:
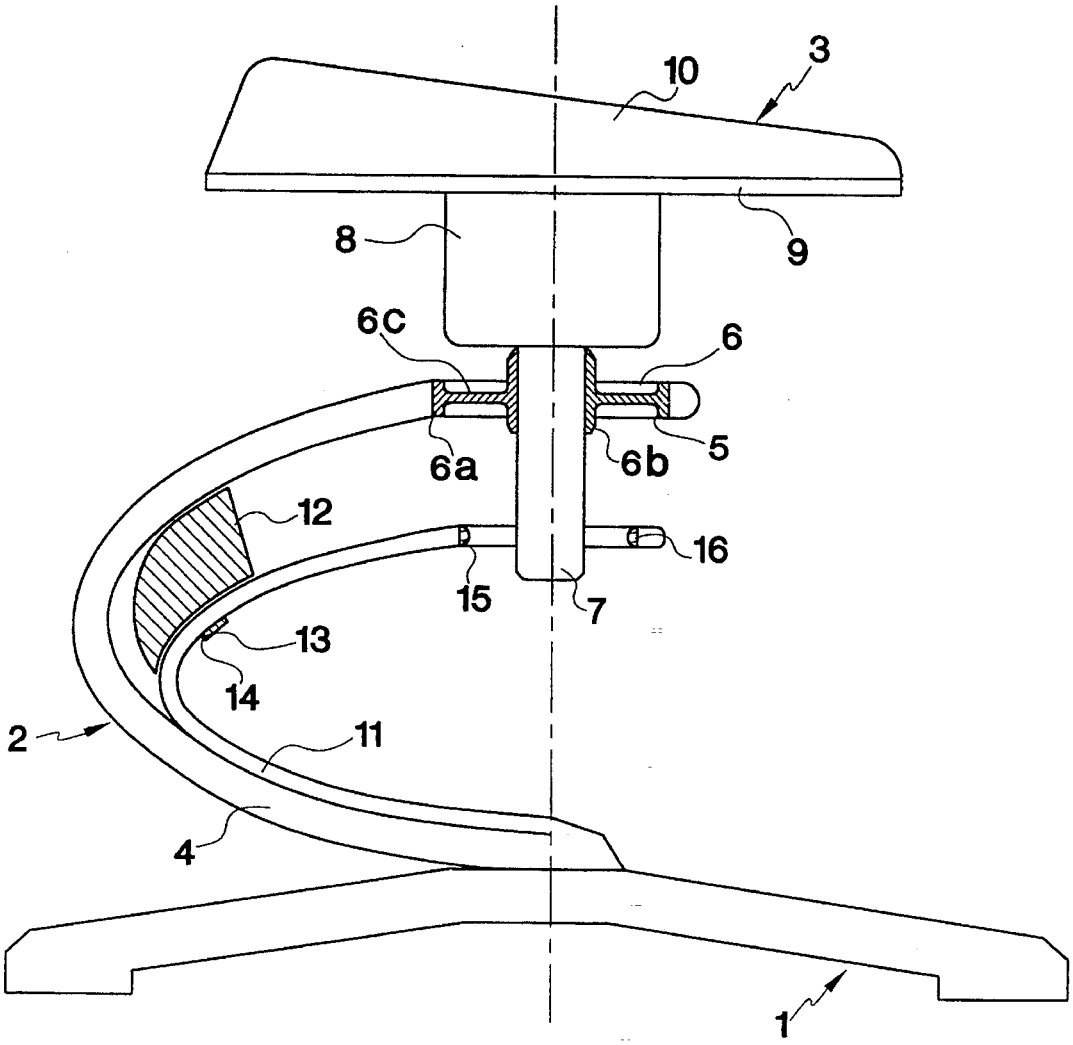
FIG. 1 shows a first embodiment of the seat according to this invention.

The embodiment of the active dynamic seating device according to this invention illustrated in FIG. 1 consists of a base 1, an intermediate piece 2 connected thereto, and a seat part 3.

The base 1 exhibits, as is known, several feet arranged in stellate fashion and integrally connected at their inner ends.

With the central zone of the base 1, formed in this way, a first arcuate resilient part 4 of the intermediate piece 2 is connected, this part having substantially a U-shaped configuration. The arcuate part 4 can herein consist of a correspondingly dimensioned steel spring strip or synthetic resin spring band.

In a preferred embodiment, the U-shaped intermediate piece 2 is connected to the base 1 to be rotatable about a vertical axis.

The upper leg of part 4 exhibits a bore 5 in its forward region, the vertical axis of this bore passing through the center of the base 1. The bore 5 serves for receiving a flexible diaphragm 6, for example a rubber diaphragm, serving as the bearing for the seat part 3.

The flexible diaphragm 6 exhibits, for mounting in the bore 5, a broadened marginal zone **6*a* which latter is glued to the inner wall of the bore 5 and/or is attached in the bore 5** by means of retaining devices not illustrated in detail.

For retaining and/or supporting the seat part 3, the central zone of the flexible diaphragm 6 is designed as a hollow cylinder **6*b* serving for the accommodation of a cylindrical part 7 arranged on the underside of the seat part 3**.

The cylindrical part 7, preferably pressed into the hollow cylinder **6*b* of the flexible diaphragm 6, exhibits at its upper end a region 8 having an enlarged diameter, by way of which the cylindrical part 7 is connected with a preferably circularly designed plate 9 of the seat part 3**.

Figure 3:
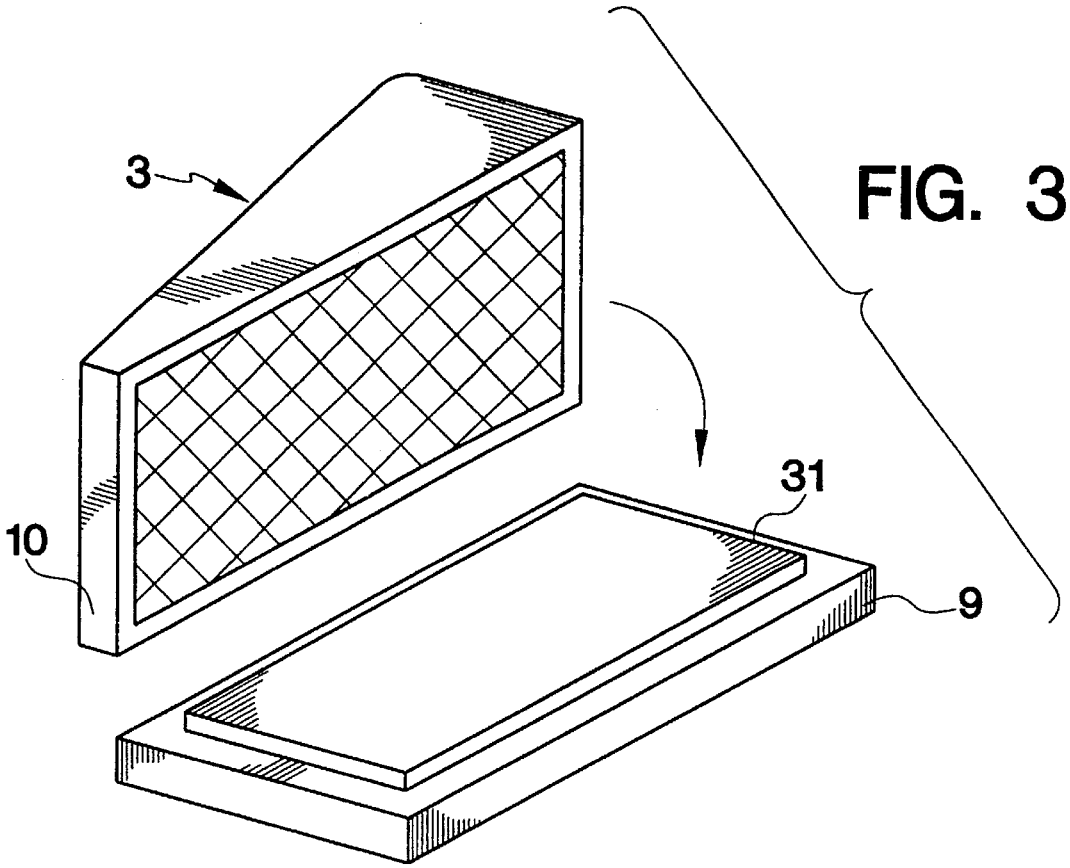
FIG. 3 shows the fixing means for selectively affixing a seat cushion to a seat plate.

A seat cushion 10 is arranged on the topside of the seat part 3. The seat cushion 10 can consist, for example, of fabric-covered foam material and can be connected to the plate 9 optionally fixedly or releasably, as by known conventional selective fixing means 31 shown by a block in FIG. 3. In order to promote an anatomically favorable sitting attitude, the seat cushion 10 can be designed to be convex, concave, planar, or wedge-shaped. In case of a wedge-shaped design, the higher end of the wedge should be in the back of the seated person.

Furthermore, the seat cushion can exhibit a dimensionally stable core in a preferred embodiment in order to maintain the shape desired for improving the sitting attitude essentially even under load.

The seat part 3 of the seating device according to this invention can thus be tilted by means of the flexible diaphragm 6 into any desired lateral direction and is supported substantially rigidly in the vertical direction. The tilting movement herein is made possible, in particular, by the annular zone **6*c* of the flexible diaphragm 6**.

Resiliency is obtained in the vertical direction by the first arcuate part 4 of the intermediate piece 2. In this arrangement, the vertical spring mounting not only brings about an improvement in sitting comfort, but also an improvement in the active sitting position by the superposition of vertical movements and tilting motions.

Moreover, the characteristic of the labile equilibrium of the seat part 3 is determined by the restoring moment of the flexible diaphragm 6 which, in the embodiment of the invention shown in FIG. 1, takes over simultaneously the function of a restoring device serving for resetting the unstressed seat part 3 into the neutral position.

Furthermore, the intermediate piece 2 has a second arcuate, resilient part 11 connected, with its lower arm, to the lower arm of the first arcuate part 4. The second arcuate part 11 is arranged within the first arcuate part 4 in such a way that a gap with increasing width is formed with increasing distance from the connecting point of the arcuate parts.

A wedge 12 is displaceably arranged in this gap, preferably in the region between the upper arms of the arcuate parts 4 and 11 so that, by shifting the wedge 12, the hardness of the vertical spring action can be adjusted by means of the arcuate parts 4 and 11.

In order to make shifting of the wedge 12 possible, the second arcuate part 11 has, in a certain zone of the upper arm, a slotted hole through which a threaded pin 13 of the wedge 12 extends. In this way, by tightening and loosening a locking nut 14 threaded onto the threaded pin 13, the wedge 12 can be fixed in a predetermined position between the arms of the arcuate parts 4 and 11. For a simpler adjustment of the wedge 12, the locking nut 14 can be designed, for example, as a wing nut so that adjustment of the wedge 12 is possible without any tools.

Furthermore, a bore 15 is provided in the forward zone of the upper arm of the arcuate part 11, this bore extending centrally to the bore 5 in the first arcuate part 4. The cylindrical part 7 of the seat part 3 supported by means of the flexible diaphragm 6 in the first arcuate part 4 of the intermediate piece 2 is designed so that it projects with its lower end also through the bore 15 in the second arcuate part 11. In this way, the maximum tilting angle of the seat part 3 is limited in dependence on the relationship of the outer diameter of the cylindrical part 7 and the diameter of the bore 15. In order to permit a softer abutment, a rubber ring 16 can be arranged in the bore 15.

Of course, the seat part 3 of the seating device according to this invention illustrated in FIG. 1 can also be connected with the intermediate piece 2 by any other arbitrary bearing permitting a tilting movement in any desired lateral direction. This can take place, for example, by the use of a universal suspension of the seat part 3 in the intermediate piece 2. Since, however, in this case, no restoring forces are produced on account of the type of bearing, additional restoring devices must be provided engaging at the cylindrical part 7 or at the underside of the plate 9 of the seat part 3. These restoring devices can be designed, for example, as tension or compression springs engaging in the bore 15 between the cylindrical part 7 and the inner wall of the bore 15.

Furthermore, the intermediate piece 2 can be of any other desired type of structure, providing that a resiliency is present in the vertical direction.

Moreover, the base 1 can also assume any other desired shape ensuring the stability of the seating device. Additionally, several casters can be arranged at the base 1 in order to permit an easy shifting of the seating device.

Finally, the base 1 can exhibit a bearing surface that is curved downwardly in a slightly convex fashion, likewise facilitating the displacement of the seating device on account of the smaller supporting area. Furthermore, it has been found that such a very slight curvature of the supporting surface—with a diameter of the base of about 50 cm to 60 cm, the marginal zone of the base should have a spacing of about 0.5 cm to 1 cm from a planar supporting surface—has a positive effect on the desired sitting attitude.

These aforedescribed possible modifications of the invention are, of course, true analogously for the embodiment of the invention described below.

Figure 2:
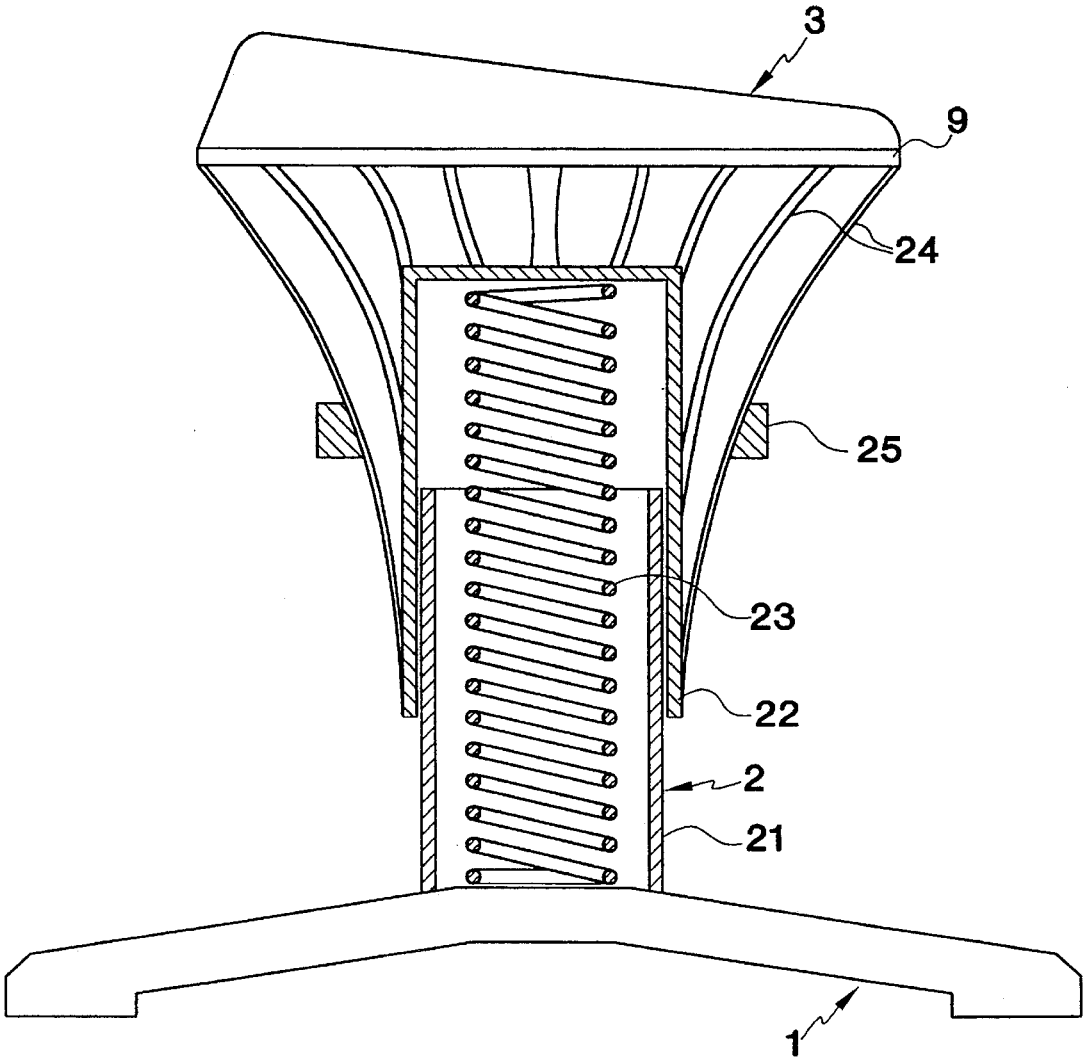
FIG. 2 shows a second embodiment of the seat according to this invention.

The embodiment of the invention illustrated in FIG. 2 consists likewise of a base 1, an intermediate piece 2, as well as a seat part 3.

In this arrangement, the base 1 and the seat part 3 are essentially identical to the corresponding parts of the embodiment shown in FIG. 1. On account of the different support of the seat part 3 on the intermediate piece 2, however, the use of the cylindrical part 7 in FIG. 1 can be omitted.

The intermediate piece 2 consists of a lower hollow cylinder 21 arranged on the base 1 and rigidly connected thereto, as well as of an upper hollow cylinder 22, the internal diameter of which is only slightly larger than the outer diameter of the lower hollow cylinder 21 so that the upper hollow cylinder 22 is guided on the lower hollow cylinder 21 to be displaceable in the vertical direction. A resilient element 23 is arranged within the two hollow cylinders 21 and 22 and is designed preferably as a coil spring; this element acts, on the one hand, on the base 1 and, respectively, the lower wall of the lower hollow cylinder 21 and, on the other hand, on the upper wall of the upper hollow cylinder 22. In order to prevent lifting off of the upper hollow cylinder 22 from the lower hollow cylinder 21, the resilient element 23 can be connected at its top side and bottom side with the upper wall of the upper hollow cylinder 22 and the base 1 or the lower wall of the lower hollow cylinder 21.

In another embodiment of the invention, this problem could also be solved by providing that the lower hollow cylinder 21 has a slotted hole extending in the vertical direction, a pin connected to the upper hollow cylinder 22 and extending horizontally engaging into this hole. In this way, with an appropriate arrangement of the pin, a pretensioning of the spring element 23 can be achieved simultaneously.

The seat part 3, in the embodiment of the invention shown in FIG. 2, is connected by means of several spring strips 24 to the upper hollow cylinder 22 of the intermediate piece 2; these spring strips are arranged distributed over the periphery of the plate 9 of the seat part 3 and are connected to this plate. The spring strips 24 are in this arrangement preferably distributed in equidistant intervals over the periphery of the plate 9 of the seat part 3 and, respectively, the outer periphery of the upper hollow cylinder 22 of the intermediate piece 2.

Additionally, the spring strips 24 can be formed, prior to being connected with the appropriate parts of the seating device, so that they have a desired bias after connection. In this way, a desired hardness of the spring action of the seat part 3 can be set in conjunction with a ring 25 which latter is connected to the spring strips 24 at a predetermined level in the horizontal position. Moreover, the ring 25 can be connected with the spring strips 24 to be displaceable in the vertical direction so that even a subsequent changing of the spring characteristic is made possible.

In this embodiment of the invention shown in FIG. 2, the connection of the seat part 3 with the intermediate piece 2 by means of the spring strips 24 not only permits a pure tilting movement about a fixed point, but also smaller transverse movements of the seat part 3 and/or overlapping of tilting and transverse movements. In this way, sitting on top of a ball is approximated in excellent fashion; health-promoting effects have admittedly been attributed to such a feature.

I claim:

1. An active dynamic seat comprising:

a base;

an intermediate piece connected with the base; and a seat part connected with the intermediate piece by a plurality of spring strips, each of said plurality of spring strips having a first end portion and a second end portion, each of said first end portions being connected to a periphery of the seat part and each of said second end portions being connected to an outer cylindrical periphery of the intermediate piece, the plurality of spring strips forming a springs structure.

2. The seat according to claim 1, wherein the plurality of spring strips are connected in substantially equidistant intervals around the periphery of the seat part and around the outer periphery of the intermediate piece.

3. The seat according to claim 2, wherein intermediate piece includes an upper hollow cylinder to which the spring strips are connected, a lower hollow cylinder connected with the base, the lower hollow cylinder being engaged and guided within the upper hollow cylinder in a vertical direction, and a resilient element disposed within the hollow cylinders in a vertical direction.

4. The seat according to claim 3, wherein the resilient element is a coil spring.

5. The seat according to claim 1, wherein intermediate piece includes an upper hollow cylinder to which the spring strips are connected, a lower hollow cylinder connected with the base, the lower hollow cylinder being engaged and guided within the upper hollow cylinder in a vertical direction, and a resilient element disposed within the hollow cylinders in a vertical direction.

6. The seat according to claim 5, wherein the resilient element is a coil spring.

7. The seat according to claim 1, wherein the base further includes a supporting bearing surface, the surface being slightly curved downwardly in convex fashion.

8. The seat according to claim 1 further comprising a seat cushion, the seat cushion being fixedly connected to the seat part and having a shape selected from the group consisting of planar, convex, concave and wedge.

9. The seat according to claim 1 further comprising a seat cushion, the seat cushion being releasably connected to the seat part and having a shape selected from the group consisting of planar, convex, concave and wedge.

* * * * *